United States Patent [19]

Payne

[11] 4,183,155

[45] Jan. 15, 1980

[54] INSOLE FOR FOOTWEAR HAVING FLEXIBLE ENVELOPE MEANS

[76] Inventor: William H. Payne, Rte. 9, Box 418, Meadville, Pa. 16335

[21] Appl. No.: 934,899

[22] Filed: Aug. 18, 1978

[51] Int. Cl.[2] ..... A43B 13/40; A43B 13/41

[52] U.S. Cl. ..... 36/44; 128/594

[58] Field of Search ..... 36/44, 43, 28, 29; 128/594, 582, 581, 595

[56] References Cited

U.S. PATENT DOCUMENTS

| | | | |
|---|---|---|---|
| 80,071 | 7/1868 | Heneage | 36/29 |
| 1,504,908 | 8/1924 | Sato | 128/594 X |
| 1,659,339 | 2/1928 | Vetterling | 36/29 X |
| 2,004,906 | 6/1935 | Simister | 128/594 X |
| 2,084,517 | 6/1937 | Vogel | 36/29 X |
| 4,123,855 | 11/1978 | Thedford | 36/44 |

FOREIGN PATENT DOCUMENTS

| | | | |
|---|---|---|---|
| 454529 | 10/1936 | United Kingdom | 128/594 |

*Primary Examiner*—James Kee Chi

*Attorney, Agent, or Firm*—Charles L. Lovercheck

[57] ABSTRACT

An insole made up of an upper wall and a lower wall of soft, flexible thin material sealed together around a marginal edge to form an envelope, a relatively rigid member in said envelope smaller than the area between the edges of the envelope, the upper wall being of greater area than the lower wall providing a slack portion so that the upper wall will slide on the relatively rigid member causing a massaging action to the feet.

1 Claim, 4 Drawing Figures

INSOLE FOR FOOTWEAR HAVING FLEXIBLE ENVELOPE MEANS

OBJECTS OF THE INVENTION

It is an object of the invention to provide an improved insole for a person.

Another object of the invention is to provide an insole that is simple in construction, economical to manufacture and simple and efficient to use.

Another object of the invention is to provide an insole that will give a massaging action to the foot of a person.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
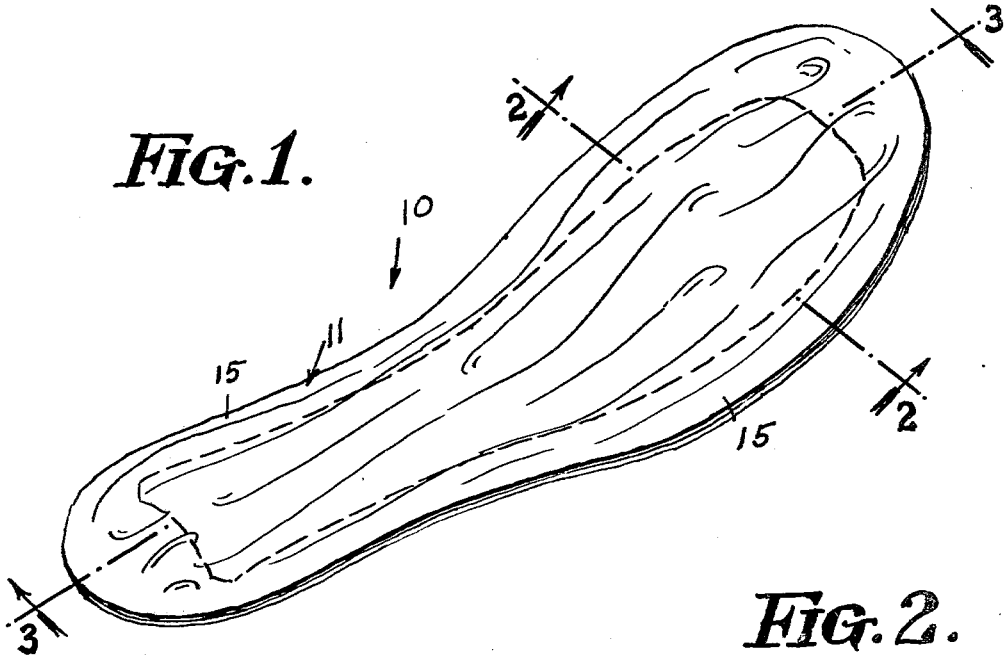
FIG. 1 is an isometric view of the insole according to the invention.
Figure 2:
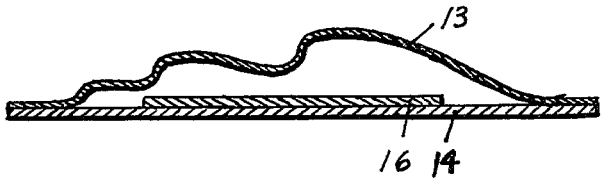
FIG. 2 is a cross-sectional view taken on Line 2—2 of FIG. 1.
Figure 3:
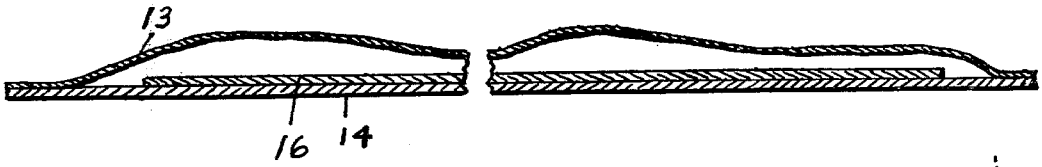
FIG. 3 is a longitudinal cross-sectional view taken on Line 3—3 of FIG. 1.
Figure 4:
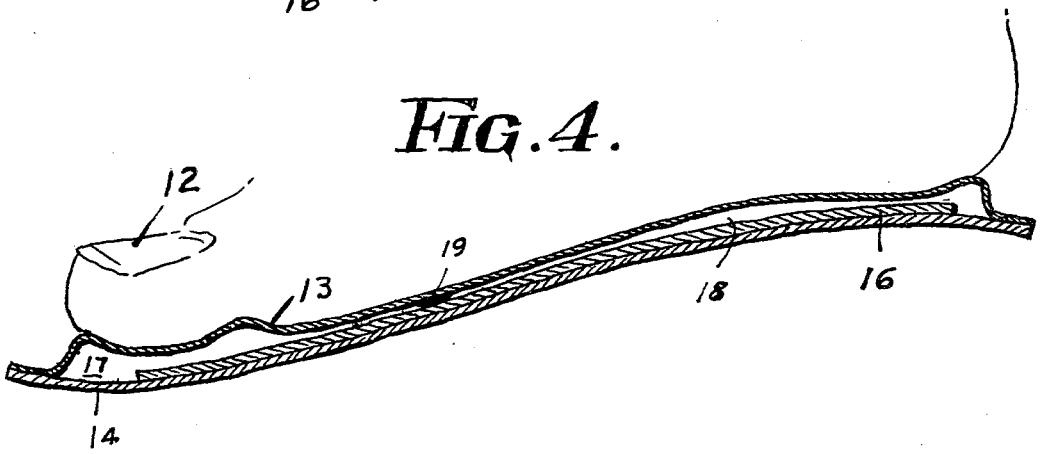
FIG. 4 is a longitudinal cross-sectional view showing the insole on the foot of a person.

The insole 10 according to the invention comprises a flexible envelope 11 adapted to extend substantially the entire length and width of the wearer's foot 12 and to fit inside of a shoe or the like. The insole has an upper wall 13 adapted to engage the under side of the wearer's foot 12 and the lower wall 14 coextensive with the upper wall and secured to the upper wall around the marginal edges 15 of the upper wall 13 forming an envelope 11.

A relatively thin rigid inner member 16 is received in the envelope. The inner member 16 is slightly shorter and slightly narrower than the inside of the envelope and narrower than the wearer's foot so that the inner member holds the central part of the upper wall in spaced relation to the lower wall to better provide a sliding action therebetween.

The thin inner member has a low frictional force on the upper member so that the foot freely slides and is massaged.

The upper wall is slightly greater in area than the lower wall between the marginal edges and therefore the air trapped inside the envelope causes the upper wall to balloon up around the wearer's foot to conform to its shape. Displacing the air from front to back by shifting of the upper wall gives a massaging action to the bottom of the foot as the wearer walks.

The material from which the upper wall and lower wall are made can be a rubberized like material supported on a fabric backing with the fabric on the inside so that the fabric better slides on the relatively rigid intermediate member.

When a person walks wearing the member disclosed herein, the wrinkles on the upper member will slide on the intermediate member giving the feet a massaging action. The wrinkles extend longitudinally of the shoe because of the greater width of the upper member than the lower member.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An insole (10) comprising, a flexible envelope (11) adapted to extend substantially the entire length and width of the wearer's foot (12) having an upper wall (13) adapted to engage the underside of the wearer's foot (12) and the lower wall (14) coextensive with and connected at the marginal edges of the upper wall (13) providing a relatively rigid border around said upper member and said lower member forming an envelope with longitudinally extending wrinkles therein, a relatively thin flat rigid inner member loosely received in said envelope between said upper wall and said lower wall and being slightly narrower and slightly shorter than the envelope and narrower than the wearer's foot, the area of said upper wall being substantially wider between the marginal edges than the lower wall whereby said upper wall wrinkles and slides on the inner member when the wearer walks providing a massaging action for the wearer's foot, the material of said upper member and said lower member being made of a rubbery like material on the outside with a fabric backing resting on the flat rigid inner member providing a sliding surface design, said inner member being made of a material having the properties of thin rigid cardboard, the flat rigid inner member having a low coefficient of friction relative to the upper wall whereby the foot freely slides on the inner member.

* * * * *